US008246221B2

(12) United States Patent
Hashimoto et al.

(10) Patent No.: US 8,246,221 B2
(45) Date of Patent: Aug. 21, 2012

(54) REFLECTOR LED LAMP

(75) Inventors: Naotaka Hashimoto, Osaka (JP); Shinya Kawagoe, Osaka (JP); Toshiyasu Kojima, Osaka (JP)

(73) Assignee: Panasonic Corporation, Osaka (JP)

( * ) Notice: Subject to any disclaimer, the term of this patent is extended or adjusted under 35 U.S.C. 154(b) by 23 days.

(21) Appl. No.: 13/121,674

(22) PCT Filed: Sep. 7, 2010

(86) PCT No.: PCT/JP2010/005474

§ 371 (c)(1),
(2), (4) Date: Mar. 29, 2011

(87) PCT Pub. No.: WO2011/055479

PCT Pub. Date: May 12, 2011

(65) Prior Publication Data

US 2011/0233578 A1 Sep. 29, 2011

(30) Foreign Application Priority Data

Nov. 9, 2009 (JP) ..... 2009-256064

(51) Int. Cl.
*F21V 7/04* (2006.01)

(52) U.S. Cl. ..... 362/341; 362/249.02; 362/296.05

(58) Field of Classification Search ..... 362/648, 362/650, 241, 247, 249.02, 296.05, 341, 362/350

See application file for complete search history.

(56) References Cited

U.S. PATENT DOCUMENTS

| | | | | |
|---|---|---|---|---|
| 4,207,607 | A * | 6/1980 | Gulliksen | 362/282 |
| 7,794,124 | B2 * | 9/2010 | Hulsey et al. | 362/477 |
| 2003/0103348 | A1 * | 6/2003 | Hung | 362/247 |

FOREIGN PATENT DOCUMENTS

| | | |
|---|---|---|
| JP | 2004-103443 | 4/2004 |
| JP | 2005-286267 | 10/2005 |
| JP | 2007-041467 | 2/2007 |
| JP | 2007-059260 | 3/2007 |

* cited by examiner

*Primary Examiner* — David V Bruce

(57) ABSTRACT

A reflector LED lamp comprises: a reflector 18 having a spheroidal reflecting surface with an opening provided therein; a plurality of LEDs 44, 46, 48, 50, and 52 arranged in the reflector 18, on a plane perpendicular to an optical axis X of the reflector 18; and a lighting circuit operable to light the plurality of LEDs, wherein the plurality of LEDs are divided into at least a first group (LED 44) and a second group (LED 46, 48, 50, and 52), the first group arranged at a first distance from the optical axis X, the second group arranged at a second distance from the optical axis X, the second distance being longer than the first distance, and while the plurality of LEDs are lit by the lighting circuit, luminous flux per LED is larger in the first group than in the second group.

5 Claims, 8 Drawing Sheets

FIG. 4A

Luminous flux [lm] per LED

| | First group (Center) | Second group (Circumference) | Luminous flux ratio |
|---|---|---|---|
| Comparative Example 1 | 60 | 60 | 1 |
| Example 1-1 | 100 | 50 | 2 |
| Example 1-2 | 150 | 37.5 | 4 |
| Example 1-3 | 200 | 25 | 8 |

FIG. 4B

| | Comparative Example 1 | Example 1-1 | Example 1-2 | Example 1-3 |
|---|---|---|---|---|
| Maximum luminous intensity [cd] | 2413 | 3167 | 3787 | 4690 |
| Beam angle [degrees] | 12.8 | 9.8 | 8.8 | 8.0 |

FIG. 7A

Luminous flux [lm] per LED

| | First group (Inward) | Second group (Outward) | Luminous flux ratio |
|---|---|---|---|
| Comparative Example 2 | 25 | 25 | 1 |
| Example 2-1 | 37.5 | 18.75 | 2 |
| Example 2-2 | 50 | 12.5 | 4 |

FIG. 7B

| | Comparative Example 2 | Example 2-1 | Example 2-2 |
|---|---|---|---|
| Maximum luminous intensity [cd] | 2053 | 2618 | 3044 |
| Beam angle [degrees] | 13.8 | 11.6 | 10.4 |

REFLECTOR LED LAMP

TECHNICAL FIELD

The present invention relates to a reflector LED lamp, and in particular to a reflector LED lamp suitable as a substitute of a reflector halogen light bulb.

BACKGROUND ART

A reflector halogen light bulb is formed, for example, by combining a halogen light bulb with a reflector having a spheroidal reflecting surface, and is used as spot lighting in a store or a museum.

In order to decrease the frequency of replacement due to the end of life, and also to save electric power, a reflector LED lamp has drawn attention. This is because the reflector LED lamp is formed by combining a reflector and an LED (i.e., Light Emitting Diode) that has a longer life, thus consuming less electric power than a halogen light bulb.

CITATION LIST

Patent Literature

[Patent Literature 1]

Japanese Patent Application Publication No. 2007-41467

SUMMARY OF INVENTION

Technical Problem

Although an LED has been improved in brightness significantly in recent years, the brightness of the LED is much lower than that of a halogen light bulb. Therefore, the present inventors have considered a reflector LED lamp using a plurality of LEDs.

However, it was found that favorable spot lighting cannot be obtained if the reflector LED lamp is formed by simply arranging a plurality of LEDs in the reflector without due consideration.

The present invention has been achieved in view of the above problem, and an aim thereof is to provide a reflector LED lamp that obtains more favorable spot lighting than a lamp having a plurality of LEDs simply arranged therein without due consideration.

Solution to Problem

In order to solve the above problem, the present invention provides a reflector LED lamp comprising: a reflector having a spheroidal reflecting surface with an opening provided therein; a plurality of LEDs arranged in the reflector, on a plane perpendicular to an optical axis of the reflector; and a lighting circuit operable to light the plurality of LEDs, wherein the plurality of LEDs are divided into at least first and second groups, the first group arranged at a first distance from the optical axis, the second group arranged at a second distance from the optical axis, the second distance being longer than the first distance, and while the plurality of LEDs are lit by the lighting circuit, luminous flux per LED is larger in the first group than in the second group.

Also, among the plurality of LEDs, the first group may be composed of an LED arranged at an intersection of the plane and the optical axis, and the second group may be composed of two or more LEDs that are arranged along a circumference of a circle centering on the optical axis and are symmetrical with respect to the optical axis.

In this case, the opening of the reflector may have a diameter of 40 mm, the second group may be composed of four LEDs arranged along the circumference of the circle, the circle may have a diameter of 4 mm, and while the LED in the first group is lit, a luminous flux thereof may be at least twice as large as that of each LED in the second group.

Alternatively, LEDs belonging to the first group and LEDs belonging to the second group may be respectively arranged along a circumference of a first circle and a circumference of a second circle, and may be symmetrical with respect to the optical axis, the first and the second circle centering on the optical axis.

In this case, the opening of the reflector may have a diameter of 40 mm, the first group may be composed of four LEDs arranged along a circumference of a circle having a diameter of 2.8 mm, and the second group may be composed of eight LEDs arranged along a circumference of a circle having a diameter of 6.3 mm, and while each LED in the first group is lit, a luminous flux thereof may be at least twice as large as that of each LED in the second group.

Advantageous Effects of Invention

According to the reflector LED lamp of the present invention, the plurality of LEDs are arranged in the reflector, on the plane perpendicular to the optical axis of the reflector. Also, the plurality of LEDs are divided into at least first and second groups, the first group arranged at the first distance from the optical axis, and the second group arranged at the second distance from the optical axis, where the second distance is longer than the first distance. While the plurality of LEDs are lit by the lighting circuit, luminous flux per LED is larger in the first group than in the second group. With this structure, more luminous flux is concentrated onto the optical axis, compared to the case where all the plurality of LEDs are lit with the same luminous flux. As a result, light collecting efficiency by the reflector is improved, and more favorable spotlighting is obtained compared to the case where all of the plurality of LEDs are lit with the same luminous flux.

BRIEF DESCRIPTION OF DRAWINGS

FIG. 4A shows the condition of the luminous flux of each LED, in a light distribution characteristics examination with respect to Embodiment 1 and a comparative example; and FIG. 4B shows some of the examination results.

FIG. 7A shows the condition of the luminous flux of each LED, in a light distribution characteristics examination with respect to Embodiment 2 and a comparative example; and FIG. 7B shows some of the examination results.

DESCRIPTION OF EMBODIMENTS

The following describes Embodiments of a reflector LED lamp according to the present invention, with reference to the drawings. In the following Embodiments, a reflector LED light bulb is taken as an example. Here, the LED light bulb refers to a light bulb that has a base described below and is available for use by being mounted in a socket for a reflector halogen light bulb.

[Embodiment 1]

Figure 1:
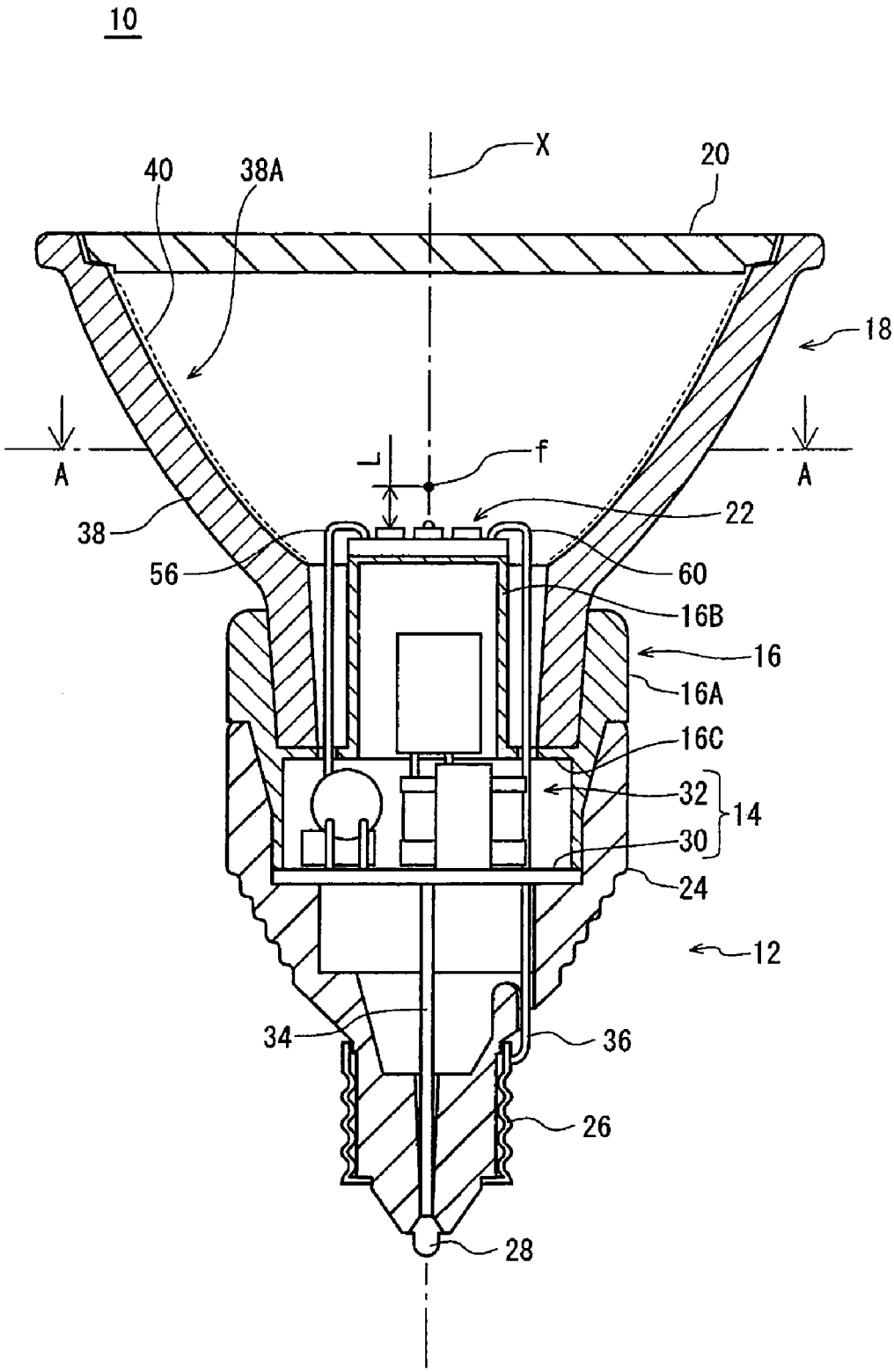
FIG. 1 is a longitudinal sectional view showing a general structure of a reflector LED light bulb according to Embodiment 1.

FIG. 1 is a longitudinal sectional view showing a general structure of a reflector LED light bulb 10 according to Embodiment 1. Note that in FIG. 1, a circuit board 30, a mounting board 42, and components mounted on these boards 30 and 42, which are described below, are not shown in section.

The reflector LED light bulb 10 includes a base 12, a lighting circuit unit 14, a heat sink 16, a reflector 18, a front glass 20, an LED module 22, etc.

The base 12 has a main body 24 made of an electric insulating material. The main body 24 has an end portion that is substantially cylindrical, and for which a shell 26 is provided. Also, the cylindrical portion has an end portion that is substantially conical frustum-shaped, and to which an eyelet 28 is fixed.

Another end portion of the main body 24, which is located opposite from the end portion to which the eyelet 28 is fixed, is hollow. The diameter of the hollow portion is larger with increasing distance from the eyelet 28, and the lighting circuit unit 14 is partially housed in the hollow portion.

The lighting circuit unit 14 is composed of the circuit board 30, and a plurality of electronic components 32 mounted on the circuit board 30. The lighting circuit unit 14 and the eyelet 28 are electrically connected to each other by a first lead wire 34. Also, the lighting circuit unit 14 and the shell 26 are electrically connected to each other by a second lead wire 36. The lighting circuit unit 14 converts commercial alternating-current power, which is supplied via (i) the eyelet 28 with the first lead wire 34 and (ii) the shell 26 with the second lead wire 36, into an electric power for lighting the LED module 22, and feeds the electric power to the LED module 22. A configuration of the lighting circuit unit 14 is described below.

The heat sink 16 has a cylindrical portion 16A. Half of the cylindrical portion 16A is fitted into the hollow portion of the main body 24. A bottomed cylindrical portion 16B is arranged inside the cylindrical portion 16A. The bottomed cylindrical portion 16B is integrated with the cylindrical portion 16A by a flange 16C that extends from an opening of the bottomed cylindrical portion 16B. The heat sink 16 is made of aluminum, and is integrally molded by die-casting or a lost-wax process.

The reflector 18 is made of borosilicate glass, and has a glass body 38 that is funnel-shaped. A concave surface 38A of the glass body 38 is formed to have a spheroidal shape. A multilayer interference film 40 constituting a reflecting surface is formed on the concave surface 38A. The multilayer interference film 40 can be formed of, for example, a metal film, such as an aluminum film or a chromium film, silicon dioxide ($SiO_2$), titanium dioxide ($TiO_2$), magnesium fluoride ($MgF_2$), or zinc sulfide (ZnS), so as to create a reflecting surface having high reflectivity. The reflector 18 has an opening diameter (i.e., reflector's inner diameter) of 40 mm size. The 40 mm size indicates that the opening diameter is in the range of 38 mm to 42 mm inclusive. Also, the reflector 18 is a so-called narrow-angle reflector. When such a narrow-angle reflector is used for a reflector halogen light bulb, the spread of the beam (i.e., beam angle) of the lamp falls within 10°±25% (=7.5° to 12.5°). Hereinafter, the range of "10°±25%" is referred to as a "standard beam angle". Note that it is possible to form facets on the reflecting surface, if necessary.

The reflector 18 has a neck portion 38B which is fitted into an upper part of the cylindrical portion 16A of the heat sink 16.

Also, the front glass 20 is fixed to the opening of the reflector 18 by an adhesive.

Figure 2A:
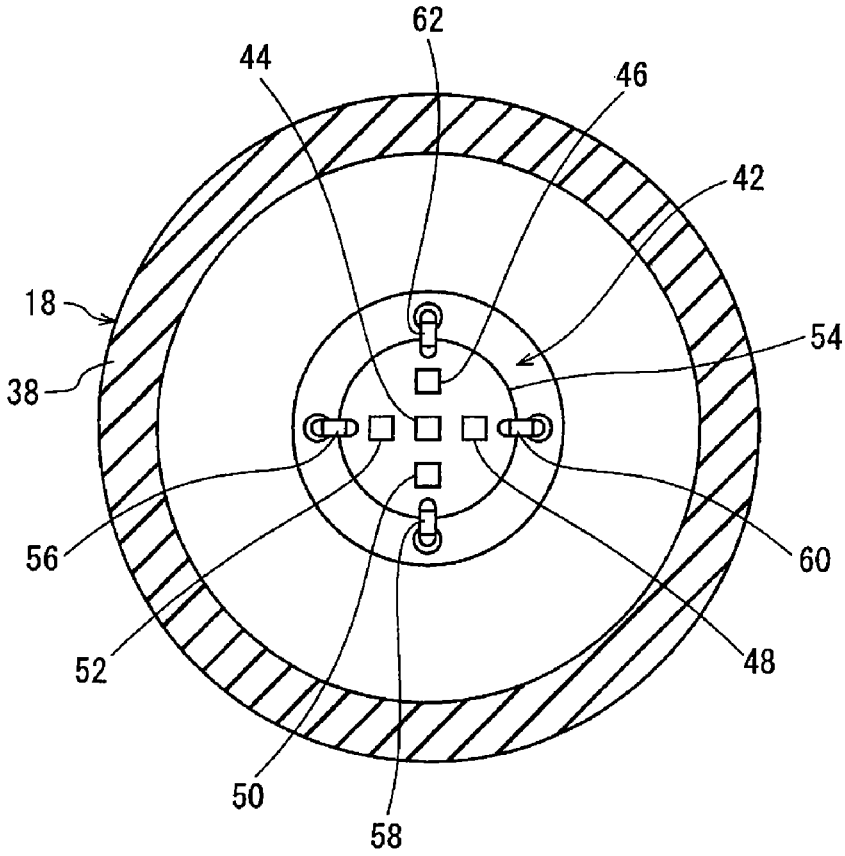
FIG. 2A is a sectional view of the light bulb in FIG. 1, taken along the line A-A.

The LED module 22 is fixed to an outer bottom surface of the bottomed cylindrical portion 16B of the heat sink 16. FIG. 2A is a sectional view of the lamp in FIG. 1, taken along the line A-A.

The LED module 22 has the mounting board 42 and a plurality of (five in the present embodiment) white LEDs 44, 46, 48, 50, and 52. The mounting board 42 is composed of an insulating plate 54 which is circular, and a wiring pattern (not shown) formed on an upper surface of the insulating plate 54. The mounting board 42 has a mounting surface perpendicular to an optical axis X (see FIG. 1) of the reflector 18. The white LEDs 44, 46, 48, 50, and 52 are mounted on the mounting surface.

The white LEDs 44, 46, 48, 50, and 52 have the same structure and the same size. Each of the white LEDs 44, 46, 48, 50, and 52 is made of, for example, an LED chip (not shown) and a phosphor dispersion resin for sealing the LED chip (squares in FIG. 2A are the outlines of the phosphor dispersion resins). LEDs that emit blue-light are used as the LED chips, for example. Silicone resin, for example, is used as the phosphor dispersion resin. Also, as phosphor powder for dispersion, it is possible to use yellow-green phosphor powder such as $(Ba, Sr)_2SiO_4:Eu^{2+}$ or $Y_3(Al, Ga)_5O_{12}:Ce^{3+}$, and red phosphor powder such as $Sr_2Si_5N_8:Eu^{2+}$ or $(Ca, Sr)S:Eu^{2+}$. When the LED chips emit light, blue light emitted from each LED chip is partially absorbed by the corresponding phosphor and converted into yellow-green light and red light. The blue, yellow-green, and red lights are combined into white light and emitted from the phosphor dispersion resin. As shown in FIG. 2A, each of the white LEDs 44, 46, 48, 50, and 52 has a size of 1 mm square in a plan view (i.e., the outline of the phosphor dispersion resin is 1 mm square).

Referring back to FIG. 1, the positions of the white LEDs 44, 46, 48, 50, and 52 in the direction of the optical axis X are set such that the upper surfaces of the white LEDs 44, 46, 48, 50, and 52, which are main light emitting surfaces, are arranged in an area posterior to a focus f of the reflector 18 (i.e., position closer to the base 12 than the focus f) to the end of the reflecting surface constituted by the multilayer interference film 40. This is because a position anterior to the focus f causes the beam angle to be too wide, and a position posterior to the end of the reflecting surface causes the amount of light reflected by the reflector (reflecting surface) to be too small. More preferably, the white LEDs 44, 46, 48, 50, and 52 are arranged at the position of the focus f or in the vicinity of the focus f within the aforementioned area (in the range where a distance L measured parallel to the optical axis X=0.0 mm to 1.5 mm). In the present embodiment, the white LEDs 44, 46, 48, 50, and 52 are arranged at the position where the distance L=0.8 mm.

Figure 2B:
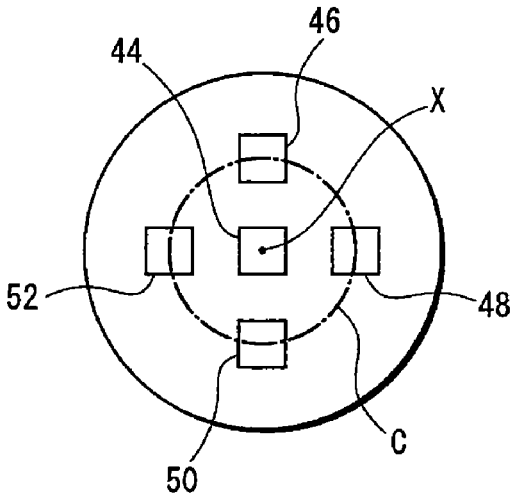
FIG. 2B is a magnified plan view of an LED module.

FIG. 2B is a magnified plan view of the LED module 22. Among the white LEDs 44, 46, 48, 50, and 52, the white LED 44 is arranged at the intersection of the optical axis X and a plane perpendicular to the optical axis X.

The rest of the white LEDs, namely, the white LEDs 46, 48, 50, and 52 are arranged along the circumference of a circle C centering on the optical axis X, and are symmetrical with respect to the optical axis X (in the present embodiment, the white LEDs 46, 48, 50, and 52 are arranged along the circumference of the circle C centering on the optical axis X, at equal angular intervals). The diameter of the circle C is 4 mm. In other words, the white LEDs 46, 48, 50, and 52 are arranged with a space of 1 mm from the white LED 44 arranged at the center.

Here, the white LEDs 46, 48, 50, and 52 are connected to each other in series by a wiring pattern (not shown), and are lit independently from the white LED 44 at the center. In other words, the five white LEDs are divided into two groups, namely a first group 70 (white LED 44) and a second group 72 (white LEDs 46, 48, 50, and 52), and are lit on a group-by-group basis. The first group 70 is electrically connected to the lighting circuit unit 14 by a third lead wire 56 and a fourth lead wire 58. The second group 72 is electrically connected to the lighting circuit unit 14 by a fifth lead wire 60 and a sixth lead wire 62.

Figure 3:
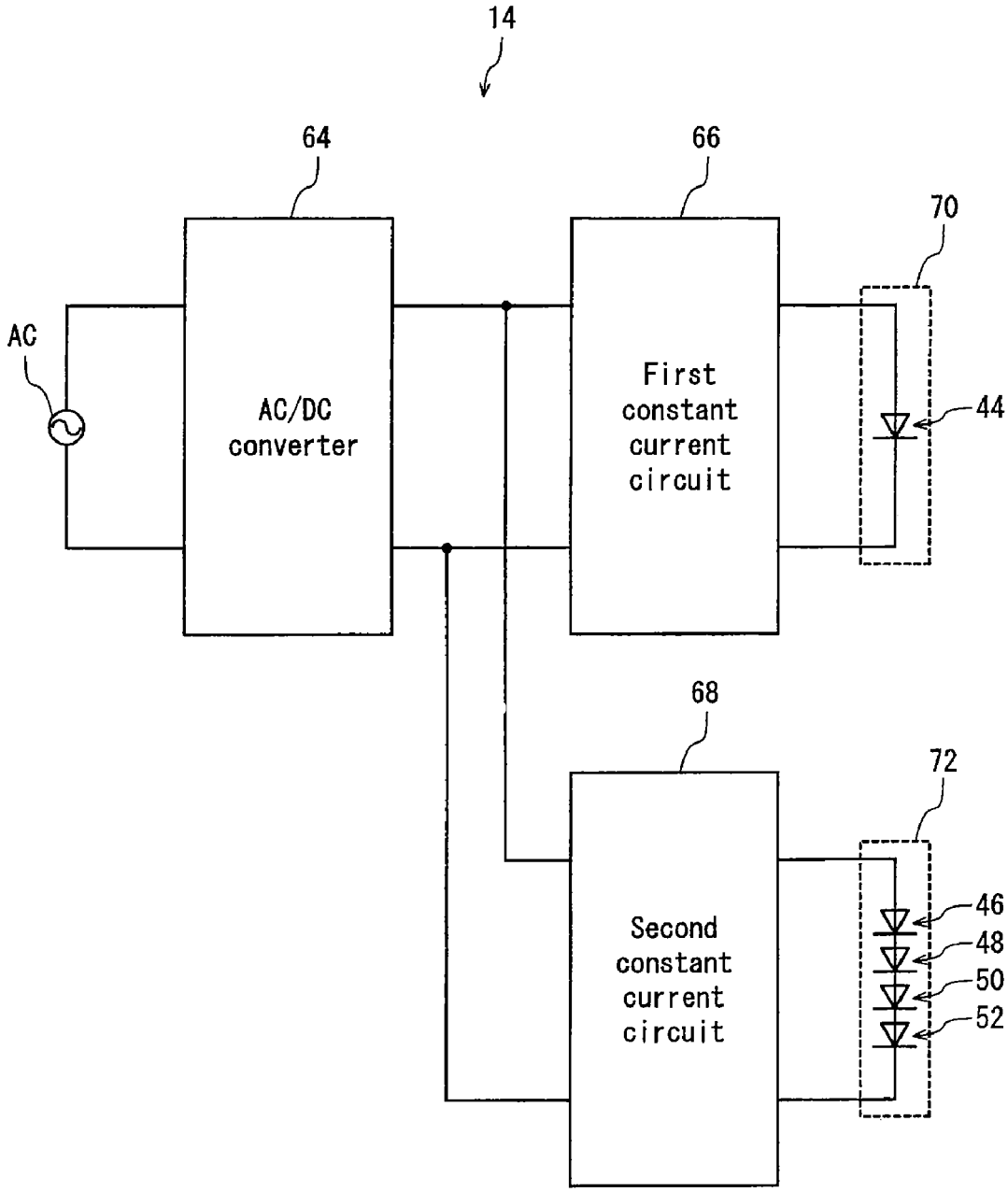
FIG. 3 is a block diagram of a lighting circuit unit.

FIG. 3 is a block diagram of the lighting circuit unit 14. The lighting circuit unit 14 includes an AC/DC converter 64, a first constant current circuit 66, and a second constant current circuit 68. The AC/DC converter 64 converts alternating-current power from an alternating-current power source AC into direct-current power. The first constant current circuit 66 supplies a constant current from the direct-current power to the first group 70. The second constant current circuit 68 supplies a constant current from the direct-current power to the second group 72. Here, the current supplied from the first constant current circuit 66 is greater than the current supplied from the second constant current circuit 68. As a result, when lit, the white LED 44 in the first group 70 produces luminous flux larger than each of the white LEDs 46, 48, 50, and 52 in the second group 72.

The present inventors set luminous flux (lm) per one white LED for each of the first and the second groups 70 and 72, as shown in FIG. 4A, and examined light distribution characteristics (light distribution curves) on an irradiation surface located one meter away from the reflector LED light bulb.

In Comparative Example 1, the luminous flux of each white LED is set to 60 m. In Examples 1-1 to 1-3, the luminous flux of the white LED in the first group 70 is larger than that of each white LED in the second group 72. Specifically, the ratio of the luminous flux of the white LED in the first group 70 to that of each white LED in the second group 72 is set to "2" in Example 1-1, "4" in Example 1-2, and "8" in Example 1-3.

Note that the total light flux of the five white LEDs is 300 lm in each of Comparative Example 1 and Examples 1-1 to 1-3. The total light flux is uniformly set to 300 lm so as to equalize input power (W).

Figure 5:
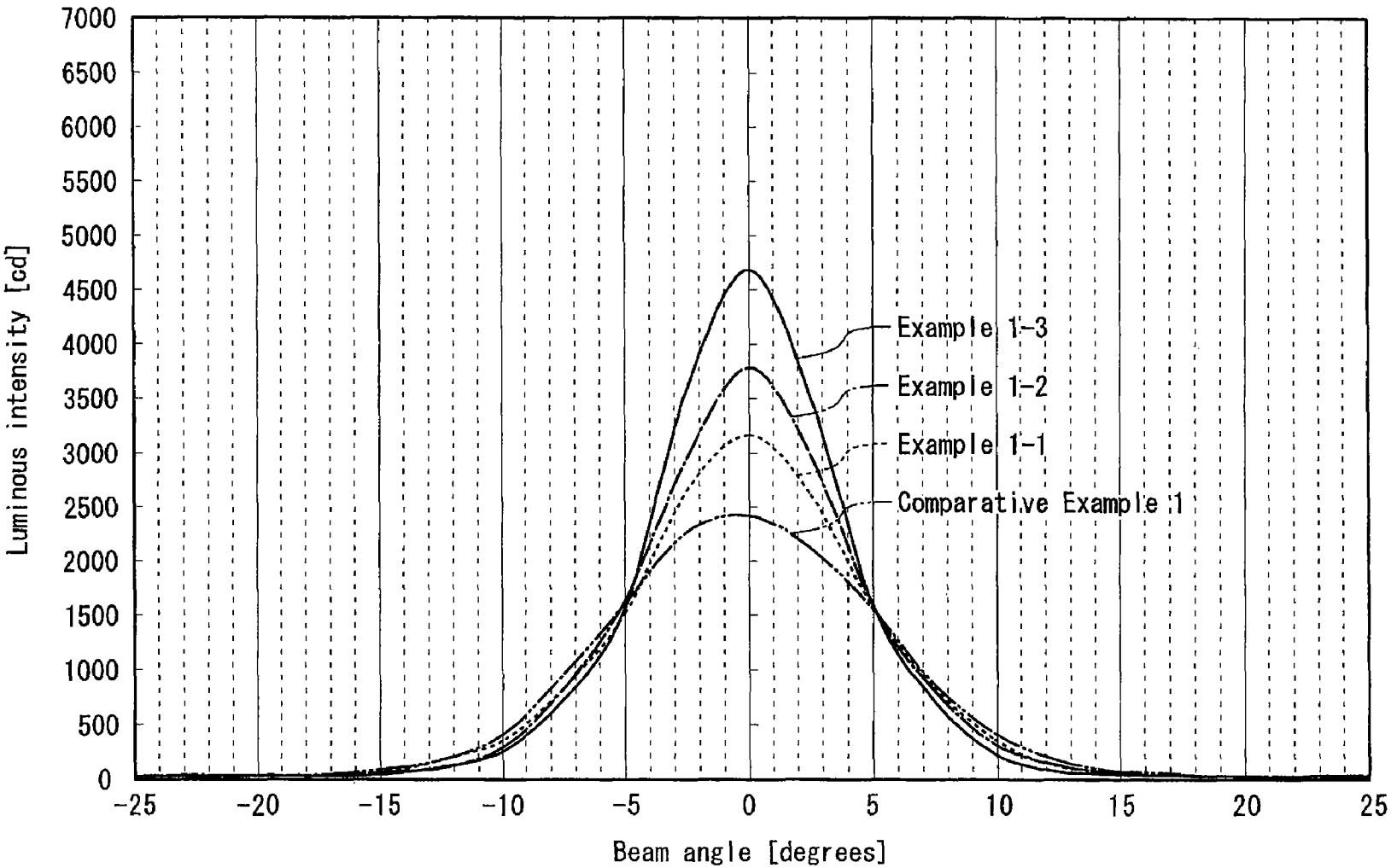
FIG. 5 shows light distribution curves, which are some of the examination results.

FIG. 5 shows results (light distribution curves) of the examination. FIG. 4B shows a maximum luminous intensity (cd) and the spread of a beam, i.e., a beam angle (degrees) in each example.

As shown in FIG. 5, the light distribution curves in Examples 1-1 to 1-3 are steeper than the distribution curve of Comparative Example 1. This means that more favorable spot lighting is obtained in Examples 1-1 to 1-3, compared to the case of Comparative Example 1.

In Comparative Example 1, the beam angle is 12.8 degrees. This value exceeds 12.5 degrees that is the upper limit of the standard beam angle of the reflector halogen light bulb (see FIG. 4B). Accordingly, the spot lighting obtained in Comparative Example 1 is not favorable as a substitute of the halogen light bulb. On the other hand, in Example 1-1, the beam angle is 9.8 degrees, which falls within the range of the standard beam angle. Accordingly, the spot lighting obtained in Example 1-1 is favorable as a substitute of the reflector halogen light bulb.

As described above, when the luminous flux of the white LED 44 (i.e., first group 70) arranged at the intersection of the optical axis X and the plane perpendicular to the optical axis X is larger than the luminous flux of each of the white LEDs 46, 48, 50, and 52 (i.e., second group 72) arranged around the white LED 44, the beam angle is narrowed compared to the case (Comparative Example 1) where all of the five white LEDs are lit with the same luminous flux.

Also, as shown in Examples 1-2 and 1-3 (see FIG. 4A), as the difference between the luminous flux of the white LED in the first group 70 and that of each white LED in the second group 72 becomes larger, the beam angle becomes narrower (see FIG. 4B) and whereby favorable spot lighting is obtained.

In this case, the beam angle falls within the range of the standard beam angle by lighting the white LED 44 in the first group 70 with the luminous flux at least twice as large as each of the white LEDs 46, 48, 50, and 52 in the second group 72.

[Embodiment 2]

A reflector LED light bulb according to Embodiment 2 basically has the same structure as the reflector LED light bulb 10 according to Embodiment 1, except that the number of white LEDs and the arrangement thereof are different. The following descriptions focus on these differences.

Figure 6:
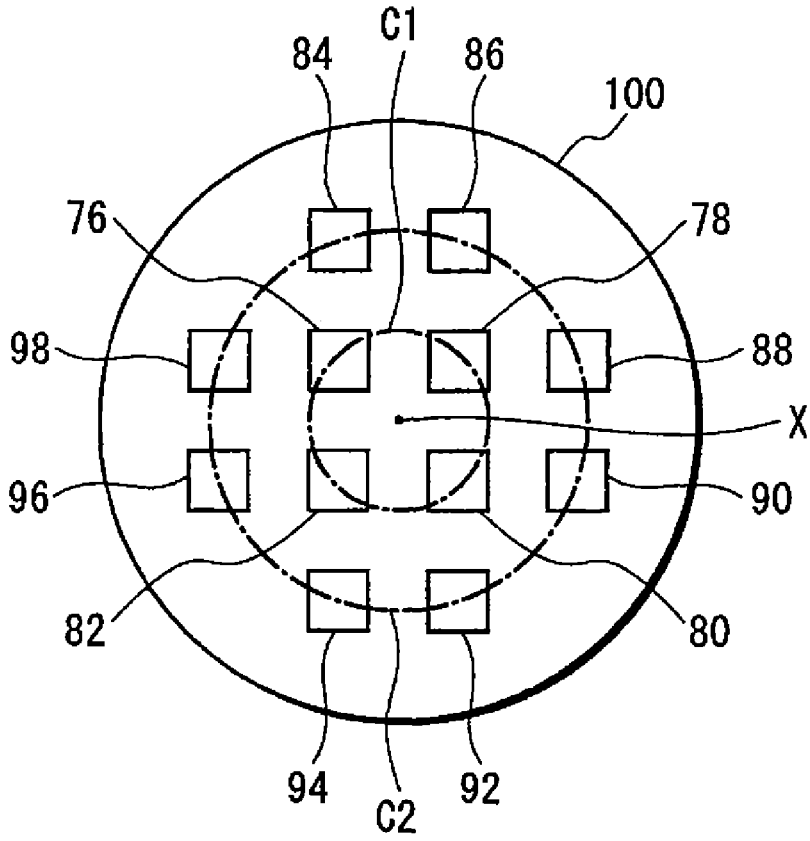
FIG. 6 is a magnified plan view showing an LED module of a reflector LED light bulb according to Embodiment 2.

FIG. 6 is a plan view showing an LED module 74 of a reflector LED light bulb according to Embodiment 2.

The LED module 74 has twelve white LEDs. Four out of the twelve white LEDs, namely white LEDs 76, 78, 80, and 82 are arranged along the circumference of a circle C1 centering on the optical axis X, at equal angular intervals. The white LEDs 76, 78, 80, and 82 constitute a first group. The remaining eight white LEDs, namely, the white LEDs 84, 86, 88, 90, 92, 94, 96, and 98 are arranged along the circumference of a circle C2 centering on the optical axis X, at equal angular intervals. The circle C2 is larger than the circle Cl. The white LEDs 84, 86, 88, 90, 92, 94, 96, and 98 constitute a second group. Note that the structure and the size of each white LED are the same as those in Embodiment 1. The twelve white LEDs are arranged in matrix at 1 mm intervals, as shown in FIG. 6. Accordingly, the diameter of the circle C1 is $2\sqrt{2}$(=2.8) mm, and the diameter of the circle C2 is $2\sqrt{10}$ (=6.3) mm.

The white LEDs 76, 78, 80, and 82 in the first group are connected to each other in series by a wiring pattern (not shown) of a mounting board 100. The white LEDs 84, 86, 88, 90, 92, 94, 96, and 98 in the second group are also connected to each other in series by a wiring pattern (not shown) of the mounting board 100.

The white LEDs in the first and the second groups are lit by a lighting circuit unit having the same configuration as that of Embodiment 1 (i.e., a lighting circuit unit that converts commercial alternating-current power into direct-current power, and supplies constant currents for the respective groups from the direct-current power).

Similarly to Embodiment 1, the present inventors set different luminous fluxes between the white LEDs in the first group and the white LEDs in the second group, and examined light distribution characteristics of the white LEDs in the first and the second groups.

In other words, the present inventors set luminous flux [lm] per one white LED for each of the first and the second groups, as shown in FIG. 7A, and examined light distribution characteristics (light distribution curves) on an irradiation surface located one meter away from the reflector LED light bulb.

In Comparative Example 2, the luminous flux of each white LED is set to 25 lm. In Examples 2-1 to 2-2, the luminous flux of each white LED in the first group is larger than that of each white LED in the second group. Specifically, the ratio of the luminous flux of each white LED in the first group to that of each white LED in the second group is set to "2" in Example 2-1 and "4" in Example 2-2.

Note that the total light flux of the 12 white LEDs is 300 lm in each of Comparative Example 2 and Examples 2-1 to 2-2, for the same reason as Embodiment 1.

Figure 8:
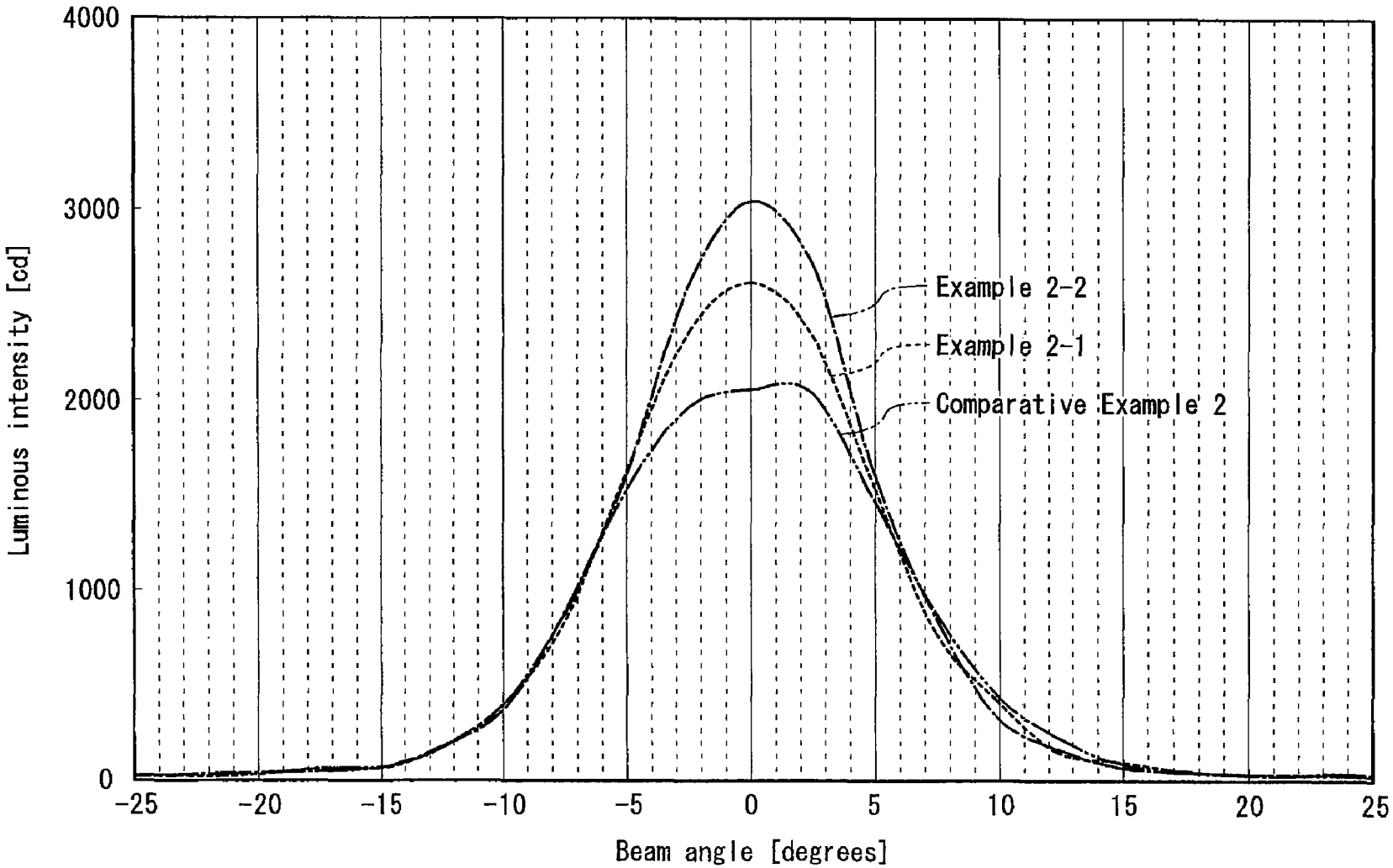
FIG. 8 shows light distribution curves, which are some of the examination results.

FIG. 8 shows results (light distribution curves) of the examination. FIG. 7B shows a maximum luminous intensity (cd) and the spread of a beam, i.e., a beam angle (degrees) in each example.

As shown in FIG. 8, the light distribution curves in Examples 2-1 to 2-2 are steeper than the distribution curve of Comparative Example 2. This means that more favorable spot lighting is obtained in Examples 2-1 to 2-2, compared to the case of Comparative Example 2.

In Comparative Example 2, the beam angle is 13.8 degrees. This value exceeds 12.5 degrees that is the upper limit of the standard beam angle of the reflector halogen light bulb (see FIG. 7B). Accordingly, the spot lighting obtained in Comparative Example 2 is not favorable as a substitute of the halogen light bulb. On the other hand, in Example 2-1, the beam angle is 11.6 degrees, which falls within the range of the standard beam angle. Accordingly, the spot lighting obtained in Example 2-1 is favorable as a substitute of the reflector halogen light bulb.

As described above, when the luminous flux of each of the white LEDs 76, 78, 80, and 82 (i.e., first group), which are arranged along the circumference of the circle C1 centering the optical axis X, is larger than the luminous flux of each of the white LEDs 84, 86, 88, 90, 92, 94, 96, and 98 (i.e., second group) arranged around the white LEDs 76, 78, 80, and 82, the beam angle is narrowed compared to the case (Comparative Example 2) where all of the 12 white LEDs are lit with the same luminous flux.

Also, as shown in Examples 2-1 and 2-2 (see FIG. 7A), as the difference between the luminous flux of each white LED in the first group and that of each white LED in the second group becomes larger, the beam angle becomes narrower (see FIG. 7B) and whereby favorable spot lighting is obtained.

In this case, the beam angle falls within the range of the standard beam angle by lighting each of the white LEDs 76, 78, 80, and 82 in the first group with the luminous flux at least twice as large as each of the white LEDs 84, 86, 88, 90, 92, 94, 96, and 98 in the second group.

Although the reflector LED lamp according to the present invention has been described based on the above embodiments, the present invention is of course not limited to such. For example the following modifications are possible.

(1) According to Embodiments described above, the reflector is composed of the glass body and the multilayer interference film formed on the concave portion, which has a spheroidal shape, of the glass body. However, it is not limited to such. For example, the reflector may be formed with metal. In this case, it is possible to use molded aluminum, so that the reflector functions as a second heat sink that further dissipates heat transmitted from the heat sink 16 (see FIG. 1). This further increases electric power (current) supplied for the white LEDs. As a result, the luminous intensity can be improved.

(2) According to Embodiments described above, a plurality of white LEDs are divided into two groups, i.e., first and second groups. However, it is not limited to such. For example, a plurality of white LEDs may be divided into three or more groups. In this case, assume that each of the divided groups is respectively referred to as a first group, a second group, a third group, . . . , and an $N^{th}$ group (N being an integer larger than or equal to two) in the order starting from the one closest to the optical axis of the reflector. Then, by setting the luminous flux of each white LED in an (N−1) group to be larger than that of each white LED in the $N^{th}$ group, the beam angle is considered to be narrow, compared to the case where all of the white LEDs are lit with the same luminous flux. This is because the light collecting efficiency by the reflector is considered to be improved by concentrating more luminous flux onto the optical axis (focus of the reflector).

In this case, the difference in luminous flux (i.e., luminous flux ratio) per LED between each group may be determined in accordance with the size of a reflector, spacing between each LED, and the like. This enables obtaining spot lighting having light collecting efficiency (having a beam angle) equivalent to or greater than the corresponding reflector halogen light bulb.

(3) The combinations of the luminescent color of an LED chip and the phosphor powder are not limited to those described above, and may be changed appropriately in accordance with a desired light color. In other words, it is possible to change: the mixing ratio of yellow-green phosphor powder and red phosphor powder; the type of phosphor for use; and the type (luminescent color) of an LED chip, so as to change the light color to a different color such as incandescent, warm white, white, neutral white, or daylight.

(4) The above-described embodiments employ, as an LED, the white LED composed of an LED chip and phosphor dispersion resin. However, the LED may only include the LED chip.

[Industrial Applicability]

The reflector LED lamp according to the present invention is suitable as spot lighting in a store, a museum, or the like.

[Reference Signs List]

10 reflector LED light bulb
14 lighting circuit unit
18 reflector
44, 46, 48, 50, and 52 white LED
70 first group
72 second group
76, 78, 80, 82, 84, 86, 88, 90, 92, 94, 96, and 98 white LED
X optical axis of reflector

The invention claimed is:

1. A reflector LED lamp comprising:

a reflector having a spheroidal reflecting surface with an opening provided therein;

a plurality of LEDs arranged in the reflector, on a plane perpendicular to an optical axis of the reflector; and a lighting circuit operable to light the plurality of LEDs, wherein the plurality of LEDs are divided into at least first and second groups, the first group arranged at a first distance from the optical axis, the second group arranged at a second distance from the optical axis, the second distance being longer than the first distance, and while the plurality of LEDs are lit by the lighting circuit, luminous flux per LED is larger in the first group than in the second group.

2. The reflector LED lamp of claim 1, wherein among the plurality of LEDs, the first group is composed of an LED arranged at an intersection of the plane and the optical axis, and the second group is composed of two or more LEDs that are arranged along a circumference of a circle centering on the optical axis and are symmetrical with respect to the optical axis.

3. The reflector LED lamp of claim 2, wherein the opening of the reflector has a diameter of 40 mm, the second group is composed of four LEDs arranged along the circumference of the circle, the circle has a diameter of 4 mm, and while the LED in the first group is lit, a luminous flux thereof is at least twice as large as that of each LED in the second group.

4. The reflector LED lamp of claim 1, wherein

LEDs belonging to the first group and LEDs belonging to the second group are respectively arranged along a circumference of a first circle and a circumference of a second circle, and are symmetrical with respect to the optical axis, the first and the second circle centering on the optical axis.

5. The reflector LED lamp of claim 4, wherein the opening of the reflector has a diameter of 40 mm, the first group is composed of four LEDs arranged along a circumference of a circle having a diameter of 2.8 mm, and the second group is composed of eight LEDs arranged along a circumference of a circle having a diameter of 6.3 mm, and while each LED in the first group is lit, a luminous flux thereof is at least twice as large as that of each LED in the second group.

* * * * *